US005771587A

United States Patent [19]

Herold

[11] Patent Number: 5,771,587

[45] Date of Patent: Jun. 30, 1998

[54] MANUAL BELT SKIVER

[75] Inventor: Wolfgang Herold, Offenbach, Germany

[73] Assignee: Mato Maschinen-und Metallwarenfabrik Curt Matthaei GmbH & Co KG, Offenbach, Germany

[21] Appl. No.: 744,795

[22] Filed: Nov. 6, 1996

[30] Foreign Application Priority Data

Nov. 9, 1995 [DE] Germany ..... 195 41 822.0

[51] Int. Cl.[6] ..... B26B 29/00

[52] U.S. Cl. ..... 30/294; 30/486

[58] Field of Search ..... 30/294, 169, 280, 30/486, 484, 487, 492, 481

[56] References Cited

U.S. PATENT DOCUMENTS

| | | | |
|---|---|---|---|
| 421,407 | 2/1890 | Kreinberg | 30/486 |
| 991,238 | 5/1911 | Potter | 30/486 |
| 1,307,151 | 6/1919 | Rowden et al. | 30/294 |
| 1,576,661 | 3/1926 | Lawrence | 30/481 |
| 2,734,535 | 2/1956 | Neubauer | 30/486 |
| 5,553,359 | 9/1996 | Herold . | |

FOREIGN PATENT DOCUMENTS

| | | |
|---|---|---|
| 0628747A1 | 5/1994 | European Pat. Off. . |
| 4002116C2 | 3/1995 | Germany . |
| 2227703 | 4/1993 | United Kingdom . |

*Primary Examiner*—Hwei-Siu Payer
*Attorney, Agent, or Firm*—Price, Heneveld, Cooper, DeWitt & Litton

[57] ABSTRACT

A manual belt skiver removes a top layer of material along an end edge of a belt in preparation for mounting a lacing thereon. The skiver has a base with a handle attached thereto, and a normally vertical contact surface adapted to slide along the end edge of the belt during use. A knife is mounted on the base, and has a thin flat blade protruding outwardly from the contact surface, with a straight interior portion and an upwardly turned outer tip. A pressure bar is mounted on the base, generally forward of the knife, and includes a foot which protrudes laterally outwardly from the contact surface, generally above the cutting edge of the blade to guide the blade through the belt.

30 Claims, 5 Drawing Sheets

MANUAL BELT SKIVER

BACKGROUND OF THE INVENTION

The invention pertains to a manual belt skiver for removing the top layer or a part of the top layer of one end of a conveyor belt. The manual belt skiver has a main body with a base containing a level bearing surface to which a handle is attached, and a knife fastened within the main body.

Manual belt skivers are essentially familiar in the art, and serve to remove the top layer or parts of the top layer at the end of a conveyor belt to facilitate mounting a lacing thereon. It is customary to secure the belt end with a supporting device against slipping, and then undertake the operation with the skiver, while the plane or skiver is moved by hand. Generally, the construction of the belt skiver resembles that of a carpenter's plane, which is also used by hand. The belt skiver contacts the belt end with its level bearing surface support, while the slanted knife of the skiver extends beyond the bearing surface below, and cuts away top layer strips of the belt, so that wavelike recesses or indentations are created in the conveyor belt. Several passes of the belt skiver over the total width of the conveyor belt manage to make a great number of rills or channels into the conveyor belt, which removes the top layer or a part of the top layer from the end of the conveyor belt. The use of the belt skiver requires a high degree of dexterity and bodily strength, without ensuring that the planed surface is absolutely level and the thickness of the remainder of the belt wall is absolutely even in all places.

DE 40 02 116 C2 discloses a mechanized belt skiver for planing off the top layer from one end of a conveyor belt which is clamped into a supporting device. The belt skiver contains a sled which is moveable along the supporting device, and in which is located a knife, and preceding the knife, a pressure block that can be adjusted in height to correspond to the thickness of the top layer and/or to the thickness of the conveyor belt to be planed away. The knife is a thick, rigid blade, which is curved up on the free end away from the sled, in order to be able to trim off the top layer horizontally and vertically. The sled is moved by a toothed gear, which can be activated by a manual crank. Because of the step down ratio, the knife can be moved with great force through the belt while the thick, inflexible blade ensures that an even thickness of top layer is removed from the whole width of the belt. However, a disadvantage for this mechanical belt skiver is that it requires a great deal of assembly time and consequently engenders high production costs. Apart from that, it is nearly impossible for the user to simply remove locally the top layer or a part of the top layer of the belt end as preparation for attaching belt fasteners or fastening clamps, especially at the place where a replacement of a worn belt fastener or fastening clamp has to be attached to the belt.

SUMMARY OF THE INVENTION

It is therefore an objective of this invention to improve the useful properties of a belt skiver of the manual variety in such a way that, in spite of its entirely manual manipulation, the top layer of the belt, or a part thereof, can be removed in substantial widths or swaths while minimizing the amount of manual force required.

According to the invention, the manual belt skiver of the initially mentioned variety is identified by the following characteristics:

the base contains a horizontal bearing surface running along the direction of movement of the belt skiver, and a vertical belt edge contact surface, the knife is designed as a thin blade, which extends beyond the belt edge contact surface of the base and includes an upwardly turned outer corner at the front edge of the blade, there is a pressure bar mounted in the base, and aligned with the direction of movement. In the area of the bearing surface, the pressure bar extends beyond the bearing surface, and is positioned above the flat cutting section of the blade.

One aspect of the manual belt skiver according to the invention is that the base does not touch the conveyor belt with its lower bearing surface, as is the case in prior art manual belt skivers, which are designed like a carpenter's plane. Rather the present belt skiver rests with its base on a level belt support surface, on which the conveyor belt also rests. The present skiver has a contact surface, which runs vertically to the bottom bearing surface of the base in the direction of movement of the belt skiver and rest against the free end face of the conveyor belt end during use. This ensure a definite guidance of the base, and thus also the pressure bar and blade. Of special significance is the design of the knife as a thin blade. This design is a prerequisite to cut off a top layer of material from the conveyor belt with little effort, which means it is possible to use manual force. Related to the thin design of the blade, however, is the problem, that the blade is flexible and, therefore, a special interaction between the blade and the pressure bar is required to attain satisfactory cutting results. Of essential importance is also the pressure bar, the function of which is not only to press the conveyor belt against the support on which the conveyor belt rests, but it also serves for vertical guidance of the base and thus also of the blade.

In practice, excellent cutting results are achieved with a belt skiver according to the present invention. This seems to be due to the fact that, if during removing a top layer of material from a belt, the knife wants to cut deeper than is desired into the conveyor belt because of its flexible properties in the area of its cutting edge, a supporting force by the pressure bar will counteract the bending force of the blade, which thereby ensures that the blade is moved with little effort in a straight line through the belt.

The upturned outer tip of the blade limits the width of the belt strip to be cut from the belt. The extension of the curved up area of the blade in the direction of the belt height is sufficient that even when the blade bends during the cutting, the free end or tip of the blade section protrudes from the belt at the top.

The pressure bar is purposely designed as a bar-shaped component with a rectangular cross section. This design combines optimal functionality with an especially simple form.

A special model or embodiment of the invention provides for the pressure bar and the blade to be attached adjustable to one another within the main body. Because of the thin, flexible construction of the blade, and because of the difficulty of being able to precisely adjust it, the blade should remain in a fixed position within the main body. Consequently the pressure bar is made adjustable to form various recess depths.

The pressure bar is purposely fastened to the main body, and is adjustable in height and/or able to pivot around an axle which runs in the direction of movement of the conveyor belt. The depth of the cut made by the blade is thus exclusively regulated by changing the vertical position of the pressure bar. The function of the pivoting position of the pressure bar is to specifically ensure that a definite straight-line movement of the blade is achieved through the conveyor belt.

According to a special model or embodiment of the invention, the pressure bar has a level clamping surface, which runs parallel or at an acute angle to the straight interior portion of the blade.

The acute angle between the pressure bar surface and the straight inner portion of the blade should be smaller than 5°. The pressure bar is positioned so that only its free end forms a pressing surface that protrudes past the base on the top layer of the conveyor belt. If the knife has the tendency to cut deeper into the conveyor belt because the free end of the blade wants to bend downwards when the blade is moved through the conveyor belt, the pressure bar resists such motion, and tends to move the blade higher up into the conveyor belt. As a result, during the cutting process, the bottom surface of the base does not necessarily have to rest on the surface on which the conveyor belt is supported.

By the parallel adjustable alignment of the pressure bar and the straight interior portion of the blade, the pressure bar, with the base contacting the belt support surface, is moved in such a way relative to the contact surface of the base, that it comes to rest on the belt. Then the pressure bar is fed a bit farther, such as a measurement of less than 1 mm, in the direction of the contact surface of the main body. Because of the feeding motion, the base only rests on the support along the edge of its bottom bearing surface during the time the blade enters the belt, and the pressure bar only rests on the belt in its area facing the main body. If, when cutting the belt, the flexible blade penetrates deeper into the belt in the area of its free end, the blade is moved through the belt in a direction substantially parallel with the straight interior portion of the blade.

In order to achieve optimal cutting results, the straight interior portion of the blade should form an acute angle with the level bottom surface of the base. This acute angle should purposefully be smaller than 15°, to be precise, in the range of 10° to 15°.

Advantageously, the cutting edge of the tip section of the blade that is curved upward is positioned vertically to the direction of movement of the belt skiver.

If a certain tension is applied to the tip of the blade, the flexibility of the thin blade can be positively influenced, so that undesirable flexing is diminished by positioning the blade tip behind the pressure bar.

The top layer of the conveyor belt, which is to be totally or partially removed in the end area of the conveyor belt, can be in different forms. In all probability, there will be a raised surface design that has to be planed away in order to attain a flat surface area for connecting belt fasteners or fastening clamps to the belt and so ensure their optimal attachment. For instance, the raised surface design can be diamond shaped.

According to the invention, the manually operated belt skiver is destined primarily for pressing operations, in contrast to the aforementioned state of the art belt skiver resembling a carpenter's plane, which is pulled across the belt. Because the plane operator's operational force proceeds diagonally from above via his arm to the handle and so to move the main body, the base, and also the pressure bar, are firmly pressed against the conveyor belt, and so ensure optimal holding and guiding functions of the pressure bar.

Further characteristics of the invention are represented by the description of the figures and diagrams, as well as by the figures themselves, where it is noteworthy that all individual characteristics and all combinations of those characteristics are the essentials of the invention.

BRIEF DESCRIPTION OF THE DRAWINGS

The figures represent the invention in simplified form through two example models or embodiments, without being limited to them. The following is shown in.

BRIEF DESCRIPTION OF THE PREFERRED EMBODIMENTS

Figure 1:
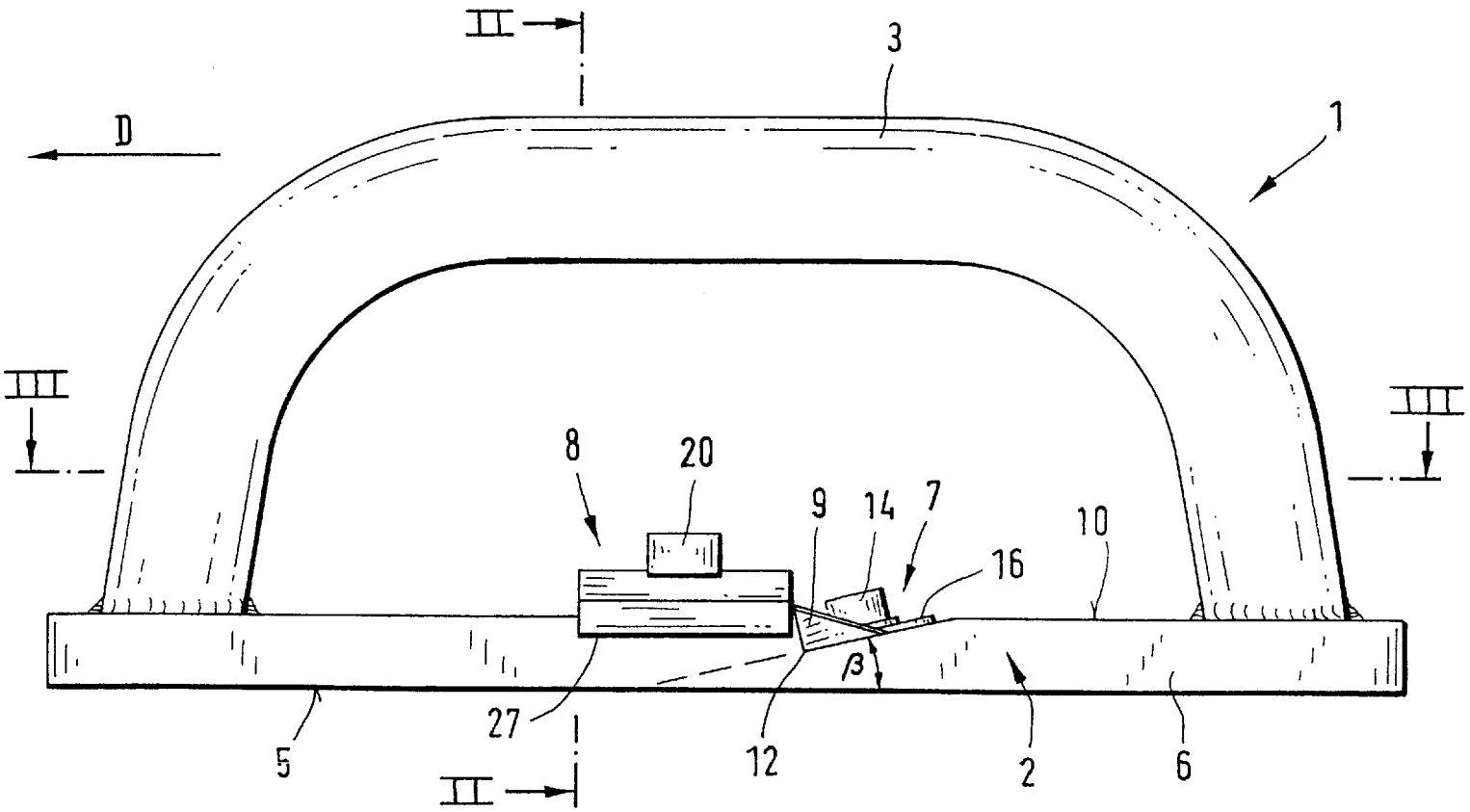
FIG. 1 is a side view of a first embodiment of the manually moveable belt skiver, according to the invention.
Figure 2:
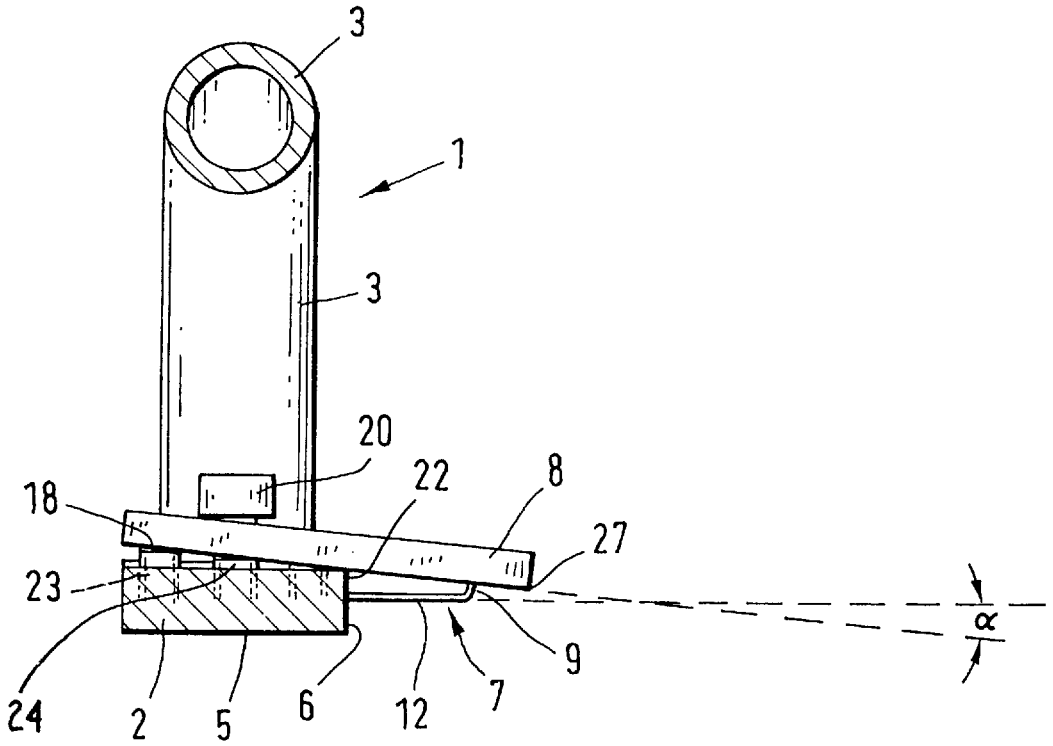
FIG. 2 is a cross section through the belt skiver along line II—II in FIG. 1.

For the purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in diagrams 1 to 5, the belt skiver 1 has a brick-shaped base 2 designed to look like a bar with a U-shaped handle 3, bent from a pipe. The free ends of handle 3 are welded to the base 2 adjacent its opposite ends, while the longitudinal center line of the handle 3 coincides with the longitudinal center line 4 of the base 2. The lower surface of the base 2, facing away from the handle 3, functions as a slide or bearing surface 5, and the side surface of the base visible in diagram 1 functions as a contact surface 6. Fastened to the base 2 is a thin, flexible blade 7, and a pressure bar 8, running in the intended direction of movement D of the belt skiver 1. The fastening of the blade 7 and pressure bar 8 occurs in the central section of the base 2, that is to say, at about half its length.

The blade 7 has a generally trapezoidal top plan shape, with pointed outer corner or tip 9 that is upturned or curved upwardly away from the bearing surface 5 of the base 2. As a receptacle for blade 7, base 2 has in the area of its upper surface 10, a recess, which forms an angle β, of 10° to 15°, between itself and upper base surface 10, as well as with the lower bearing surface 5 of the base 2. The sharpened cutting edge 12 of blade 7 is aligned with the edge 13 of recess 11, and blade 7 is tightly fastened to base 2 with a screw 14, which is screwed into a tap 15 in base 2. Blade 7 has a substantially straight interior portion 16 that is not curved upwards, with a cutting edge 12 disposed normally perpendicular to the direction of movement "D" of belt skiver 1. Screw 14 sits close to the contact surface 6, and blade 7 protrudes outwardly from the contact surface 6 of base 2 by a defined measurement, that represents about one-half of the total length of the cutting edge 12. Base 2 has another recess 17, forward of recess 11, the width of which corresponds to that of the flat, brick-shaped pressure bar 8. Recess 17 aligns with the lower surface 18 of pressure bar 8, and has a front corner 19. Pressure bar 8 is fastened to the base 2 with a screw 20, which is received into a tap 21. Pressure bar 8 extends across the whole width of the base 2 and protrudes laterally past the upturned outer tip 9 of blade 7.

Figure 3:
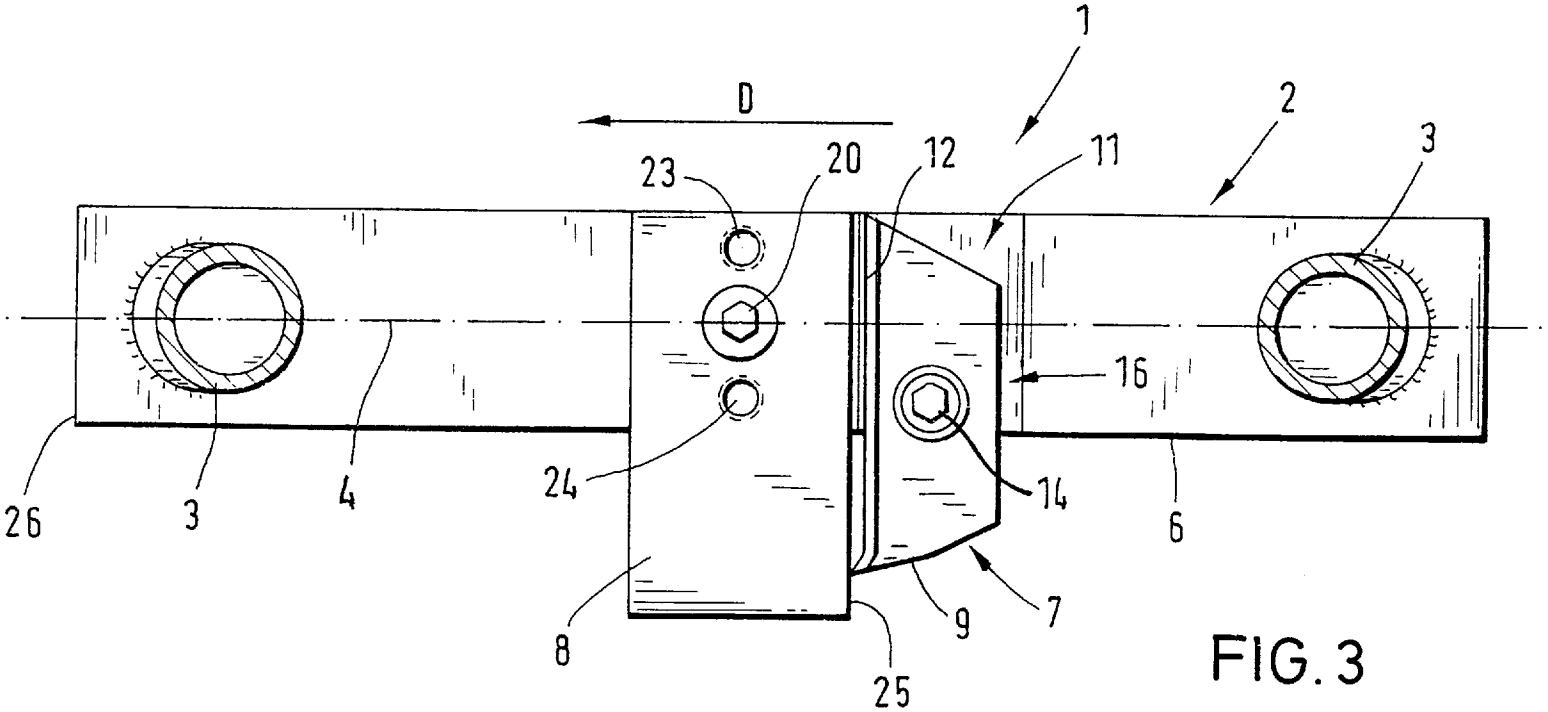
FIG. 3 is a cross section through the belt skiver along line III—III in FIG. 1.
Figure 4:
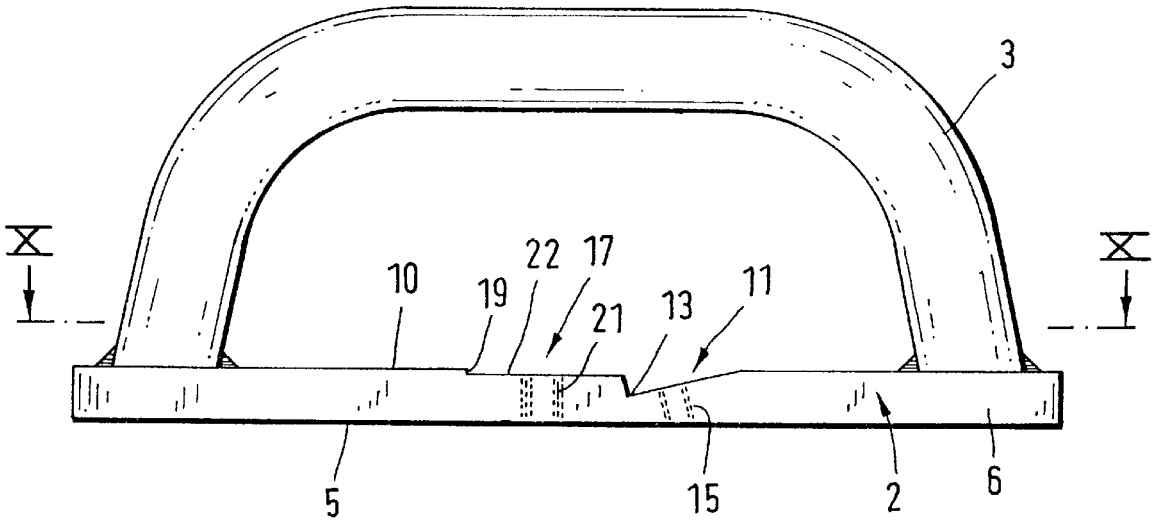
FIG. 4 is a side view of the base and the handle of the belt skiver.
Figure 5:
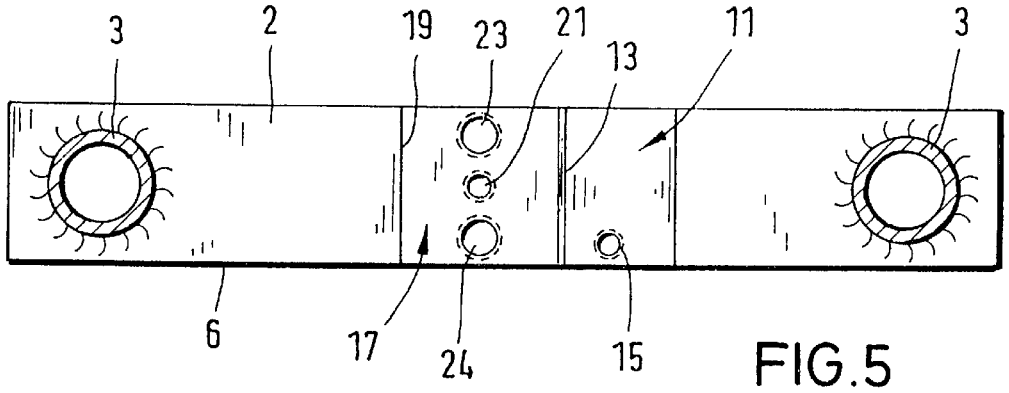
FIG. 5 is a cross section along the line V—V in FIG. 4.

The side edge 22 of base 2 in the area of pressure bar recess 17 is situated at a greater distance to the bottom bearing surface 5 of the base 2 than the corner edge 13 of the recess 11 for blade 7. Symmetrically to the screw 20 and the longitudinal center line 4 of the base 2, pressure bar 8 has two taps 23 and 24, into which screws, not shown, are tightened, so that pressure bar 8 can be positioned at any desired vertical distance to the bearing surface 5 of base 2, and in whatever desired pivotal alignment to it, by loosening the screw 20, and setting the distance of the screws (not shown) in taps and as needed. FIGS. 1 to 3 show pressure bar 8 in pivoted position around the edge 22 of base 2, in a position, where the lower edge 18 of pressure bar 8 forms an acute angle $\alpha$ with the straight interior portion 16 of the blade cutting edge 12. This angle measures at most 5°. FIG. 1 shows furthermore, that in this positions, blade tip 9 abuts or contacts the side surface 25 of pressure bar 8.

For removal of the top layer or a part of the top layer from one end of the conveyor belt (not shown), the belt skiver 1 is positioned with the contact surface 6 of base 2 against the frontal surface of the belt end, where the frontal surface initially only reaches the contact surface 6 in the area of the cutting edge 12 of the blade 7 and extends to the preceding edge 26 of the base 2. Thus pressure bar 8 rests on the belt, at least in the area of its free edge 27. In one example of the present invention, the operator holds the belt end tightly with his left hand, and with his right hand presses belt skiver 1 in the direction of movement D. This moves the slanted blade 7 through the belt, and remove a top layer of material from the belt end. Moreover, pressure bar 8 is aligned in such a way that the removal of the top layer of material from the belt occurs with a single passage of the belt skiver 1 across the belt end. The interaction between the blade 7 and the pressure bar 8 ensures that blade 7, regardless how thin and flexible it might be, is moved through the belt in a defined and controlled manner. When the belt is reduced in thickness, belt fasteners and fastening clamps can thus be attached to the recessed area at the end of the belt. This is clarified e.g. in EP 628 747 A1.

Figure 6:
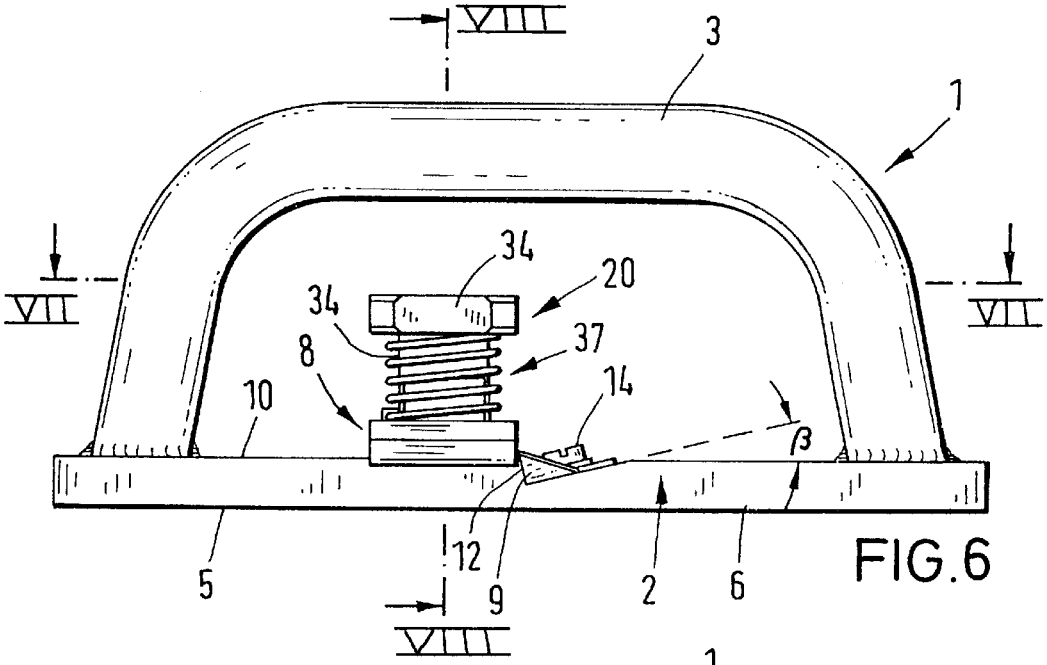
FIG. 6 is a side view of a second embodiment of the manual belt skiver, according to the invention.
Figure 7:
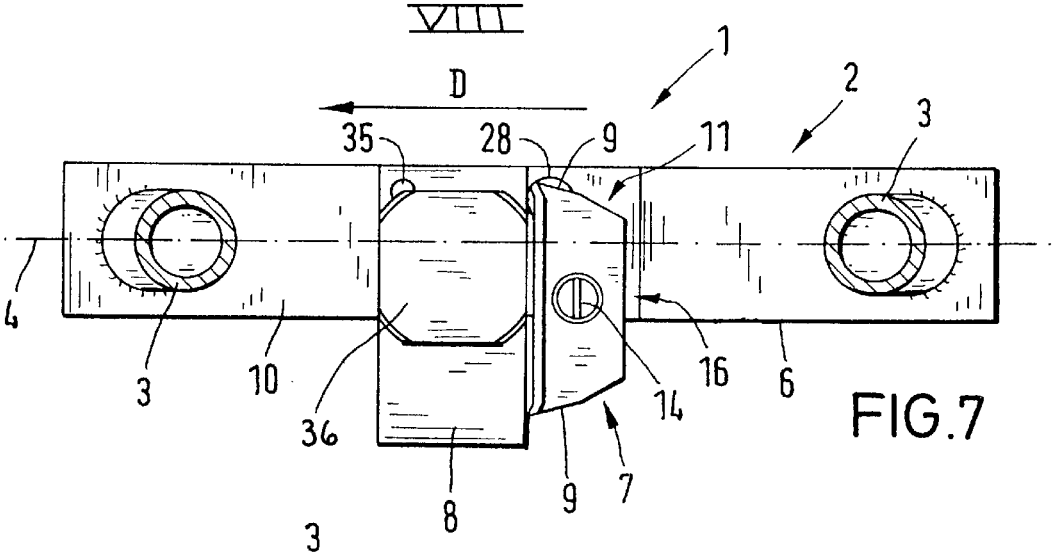
FIG. 7 is a cross section through the belt skiver along line VII—VII in FIG. 6.
Figure 8:
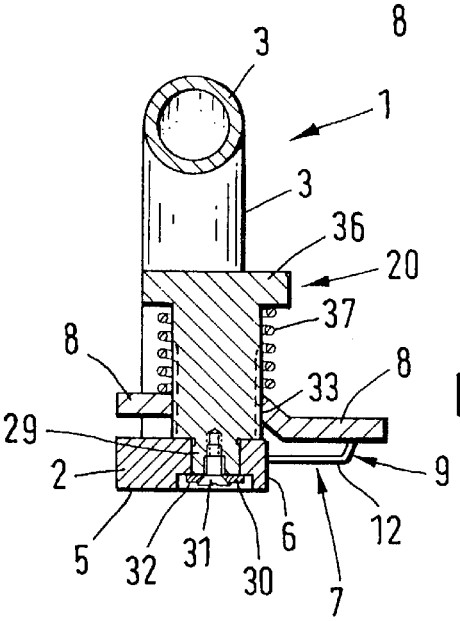
FIG. 8 is a cross section through the belt skiver along line VIII—VIII in FIG. 6.

FIGS. 6 to 8 show a second embodiment of the manually moveable belt skiver, according to the invention. Parts conforming to those in FIGS. 1 to 5 are identified with the same reference numbers, for simplicity's sake.

The belt skiver according to FIGS. 6 to 8 differs from the design in FIGS. 1 to 5 by the changed appearance of the blade 7, and its location in the base 2, and further by the changed design and location of pressure bar 8.

As can be seen in FIG. 7, blade 7, the shape of which is generally trapezoidal in top plan has pointed corners or tips 9, which are curved identically in opposite directions. When blade 7 is mounted in base 2 the lower tip 9 grips into an indentation 28 in base 2. If the cutting edge of the blade 7 extending past the base 2 has become dull from use, blade 7 can be reversed, so that the section of the blade that has not yet been used can perform the work, and the used tip 9 grips into the indentation 28 in the area of the sharp tip 9.

Pressure bar 8 is fastened with a screw 20, while the screw 20 in this second design (FIGS. 6–8) is held in a bore of the base 2 with a pivoting pin section 29 that turns without play. The screw 20 is fastened axially in the base 2 with a washer 30, which is linked to the pivotal section 29 of the screw 20 by a screw 31 and supports itself on the base 2. The base 2 has a cylindrical hollow 32 in the bottom surface 5 which accommodates the head of the screw 31, as well as a washer 30, so that these parts do not protrude beyond the bottom bearing surface 5 of base 2. Pressure bar 8 also contains a tap 33, which grips into the threaded portion of the screw 20, and prevents a relative turning motion of the screw 20. To prevent pressure bar 8 from turning when it is adjusted, a pivoting pin 35, running parallel to the turning axis of the screw 20 is linked to the base 2, and passes through a bore in pressure bar 8, essentially without play. Between the head 36 of the screw 20 and the pressure bar 8, there is a spring 37, through which the threaded section of the screw 20 passes, and which ensures that screw 20 does not loosen or tighten when the belt skiver is in use.

The embodiments of the invention in which an exclusive property or privilege is claimed are defined as follows:

1. A manual belt skiver for removing a top layer of material along an end edge of a belt in preparation for mounting a lacing thereon, comprising:

a base having a normally vertically oriented contact surface adapted to slidingly abut the end edge of the belt during use;

a handle connected with said base, and adapted for manually moving said skiver along the end edge of the belt;

a knife mounted on said base, and having a thin, generally flat blade protruding laterally outwardly from said contact surface; said blade having a sharpened forward cutting edge with a substantially straight interior portion adapted to cut a normally horizontal recess surface in the belt, and an upwardly turned outer tip adapted to cut a normally vertical recess surface in the belt;

a pressure bar mounted on said base, generally forward of said knife, and having a foot portion thereof protruding laterally outwardly from said contact surface, with a lower surface of said foot portion positioned generally above the straight interior portion of said blade cutting edge, and adapted to slidingly abut the upper surface of the belt, and guide said blade through the belt as said skiver is manually drawn across the end edge of the belt to remove the top layer therefrom.

2. A manual belt skiver as set forth in claim 1, wherein:

said pressure bar and said blade are mutually vertically adjustable to vary the depth of the horizontal recess surface cut in the belt.

3. A manual belt skiver as set forth in claim 2, wherein:

said base has a flat bottom surface adapted to slide over a belt support surface.

4. A manual belt skiver as set forth in claim 3, wherein:

said pressure bar is vertically adjustable with respect to the bottom surface of said base.

5. A manual belt skiver as set forth in claim 4, wherein:

said knife is mounted stationary in said base to minimize blade flexure during use.

6. A manual belt skiver as set forth in claim 5, wherein:

said pressure bar has a generally rectangular transverse cross-sectional shape.

7. A manual belt skiver as set forth in claim 6, wherein:

said lower surface of said foot portion is flat.

8. A manual belt skiver as set forth in claim 7, wherein:

said lower surface of said foot portion forms a first acute angle with respect to the straight interior portion of said blade cutting edge.

9. A manual belt skiver as set forth in claim 8, wherein: said first acute angle is smaller than 5°.

10. A manual belt skiver as set forth in claim 9, wherein: said straight interior portion of said blade cutting edge forms a second acute angle with respect to the bottom surface of said base.

11. A manual belt skiver as set forth in claim 10, wherein: said second acute angle is in the range of 10° to 15°.

12. A manual belt skiver as set forth in claim 11, wherein: said straight interior portion of said blade cutting edge is inclined vertically to the direction of movement of said belt skiver.

13. A manual belt skiver as set forth in claim 12, wherein: said upwardly turned outer tip of said blade cutting edge is disposed generally perpendicular to the straight interior portion of said blade cutting edge.

14. A manual belt skiver as set forth in claim 13, wherein: said knife has opposite, substantially identical sides.

15. A manual belt skiver as set forth in claim 14, wherein: said knife has an interior outer tip which grips into an indentation in said base.

16. A manual belt skiver as set forth in claim 15, wherein: said upwardly turned outer tip of said blade cutting edge abuts a trailing surface of said pressure bar.

17. A manual belt skiver as set forth in claim 16, wherein: said pressure bar can be adjusted with at least one screw within said base.

18. A manual belt skiver as set forth in claim 17, wherein: said screw is axially fastened in said base and can be pivoted with a threaded section gripping into a tap in said pressure bar, while said pressure bar is restrained from horizontal pivoting in said base.

19. A manual belt skiver as set forth in claim 18, wherein: said pressure bar is spring biased to accurately guide said blade through the belt.

20. A manual belt skiver as set forth in claim 1, wherein: said base has a flat bottom surface adapted to slide over a belt support surface.

21. A manual belt skiver as set forth in claim 1, wherein: said pressure bar is vertically adjustable with respect to said base.

22. A manual belt skiver as set forth in claim 1, wherein: said knife is mounted stationary in said base to minimize blade flexure during use.

23. A manual belt skiver as set forth in claim 1, wherein: said pressure bar has a flat lower surface which forms a first acute angle with respect to the straight interior portion of said blade cutting edge.

24. A manual belt skiver as set forth in claim 23, wherein: said straight interior portion of said blade cutting edge forms a second acute angle with respect to the bottom surface of said base.

25. A manual belt skiver as set forth in claim 1, wherein: said straight interior portion of said blade cutting edge is inclined vertically to the direction of movement of said belt skiver.

26. A manual belt skiver as set forth in claim 1, wherein: said upwardly turned outer tip of said blade cutting edge is disposed generally perpendicular to the straight interior portion of said cutting edge.

27. A manual belt skiver as set forth in claim 1, wherein: said knife has opposite, substantially identical sides.

28. A manual belt skiver as set forth in claim 1, wherein: said upwardly turned outer tip of said blade cutting edge abuts a trailing surface of said pressure bar.

29. A manual belt skiver as set forth in claim 1, wherein: said pressure bar can be adjusted with at least one screw within said base; and said screw is axially fastened in said base and can be pivoted with a threaded section gripping into a tap in said pressure bar, while said pressure bar is restrained from horizontal pivoting in said base.

30. A manual belt skiver as set forth in claim 1, wherein: said pressure bar is spring biased to accurately guide said blade through the belt.

* * * * *